United States Patent [19]

Jawetz

[11] Patent Number: 4,763,126

[45] Date of Patent: Aug. 9, 1988

[54] MOORING LOCATION SYSTEM

[76] Inventor: Ira Jawetz, 9 New Harbor Rd., Eatons Neck, N.Y. 11768

[21] Appl. No.: 926,896

[22] Filed: Nov. 4, 1986

[51] Int. Cl.[4] ..... G08G 3/00; B63B 22/02

[52] U.S. Cl. ..... 340/985; 441/3; 441/12; 441/16

[58] Field of Search ..... 340/985, 851, 689; 441/3, 11, 12, 13, 15, 16, 17; 367/3, 4; 343/709; 455/95, 99; 200/61.52

[56] References Cited

U.S. PATENT DOCUMENTS

| | | | |
|---|---|---|---|
| 1,669,055 | 5/1928 | Hogg | 441/16 |
| 2,355,013 | 8/1944 | Rochestie | 441/17 |
| 2,397,844 | 4/1946 | Dewhurst | 441/11 |
| 2,448,713 | 9/1948 | Hansell | 441/13 |
| 3,084,354 | 4/1963 | Lunenshloss | 441/11 |
| 3,181,354 | 4/1965 | Zoglio | 455/99 |
| 3,329,981 | 7/1967 | Orsino | 441/18 |
| 3,603,952 | 9/1971 | Smith | 441/13 |
| 4,099,282 | 7/1978 | Townsend | 441/16 |

FOREIGN PATENT DOCUMENTS

| | | | |
|---|---|---|---|
| 0044081 | 3/1980 | Japan | 441/13 |

*Primary Examiner*—John W. Caldwell, Sr.
*Assistant Examiner*—Alvin Oberley
*Attorney, Agent, or Firm*—Collard, Roe & Galgano

[57] ABSTRACT

A buoy for marine vessels that is responsive to a transmitted RF signal of a set frequency consisting of an RF receiver disposed within the buoy and tuned to a set frequency of the transmitted RF signal and an antenna coupled to the input of the RF receiver. A switching circuit is coupled to the RF receiver, and a lamp is disposed on the buoy so that when the RF receiver receives a signal at the set frequency, it will operate said switching circuit and turn on said lamp. The buoy may be a pick-up buoy having an elongated stem on the top of the buoy, and containing the antenna. The lamp can also be mounted on the end of the antenna. A sound source coupled to the output of the switching circuit can sound an audible signal in response to the transmitted RF signal.

8 Claims, 3 Drawing Sheets

MOORING LOCATION SYSTEM

This invention relates to an improved buoy for locating moorings.

More particularly, this invention relates to an improved buoy which is responsive to an external radio source so that the buoy can be located in fog or at night.

For boats which return to populated mooring areas having many mooring buoys, it is often difficult to locate the assigned buoy for the boat, especially at night or in fog conditions. This is particularly true in mooring areas where most of the buoys are of the same type and configuration. In mooring areas where there are large numbers of pick-up buoys and mooring buoys located some distance off shore, it is often difficult to locate one's assigned mooring. Accordingly, the present invention provides a mooring, or pick-up buoy, which is responsive to an external radio source so that it will flash a light or emit a sound, or both, when a transmitter sends a radio signal at a specific frequency. Thus, when a boat or ship drops its mooring in the mooring area, it can be assured of locating the mooring at a later time in all conditions of weather or at night when it approaches the mooring area.

The apparatus of the present invention utilizes a miniature radio receiver coupled to a flashing lamp and a beeper tone. In a preferred embodiment, the stick of the pick-up buoy also serves as its antenna, and as a mast for supporting the indicator light. A separate transmitter may also be provided that is tuned to a specific frequency so that when that frequency is transmitted to the buoy or mooring of the invention, its receiver will operate a switching circuit to turn on a flashing lamp, such as a flash or strobe light, and a beeper.

There have been known in the prior art different transponders for both aviation and marine use which are responsive to a transmitted radio signal for producing a warning or indication. The patent to Dodge, U.S. Pat. No. 3,787,867, provides a navigational buoy system that is responsive to a transmitted signal for providing synchronized navigation lights along a straight line of buoys when a radio signal is transmitted. The patent to Arenstein, U.S. Pat. No. 2,497,852, provides a transmitter buoy containing a seawater battery to transmit signals in response to sea conditions. None of the prior art radio buoys, however, are designed for locating a mooring or buoy within a mooring area by an approaching craft.

Accordingly, it is an object of the present invention to provide a mooring buoy or pick-up buoy capable of transmitting a bright light or sound in response to a transmitted radio signal.

It is another object according to the present invention to provide a mooring float or pick-up buoy capable of signaling an approaching ship during fog or at night in response to a radio signal in order to aid in the location of that buoy.

It is still a further object according to the present invention to provide a buoy capable of transmitting a sound or light in response to a radio signal which is simple in design, reliable in operation, and inexpensive in cost.

Other objects and features according to the present invention will become apparent from the following detailed description considered in connection with the accompanying drawings which disclose the embodiments of the invention. It is to be understood that the drawings are designed for the purpose of illustration only and not as a definition of the limits of the invention.

In the drawings, wherein similar reference characters denote similar elements throughout the several views.

Figure 1:
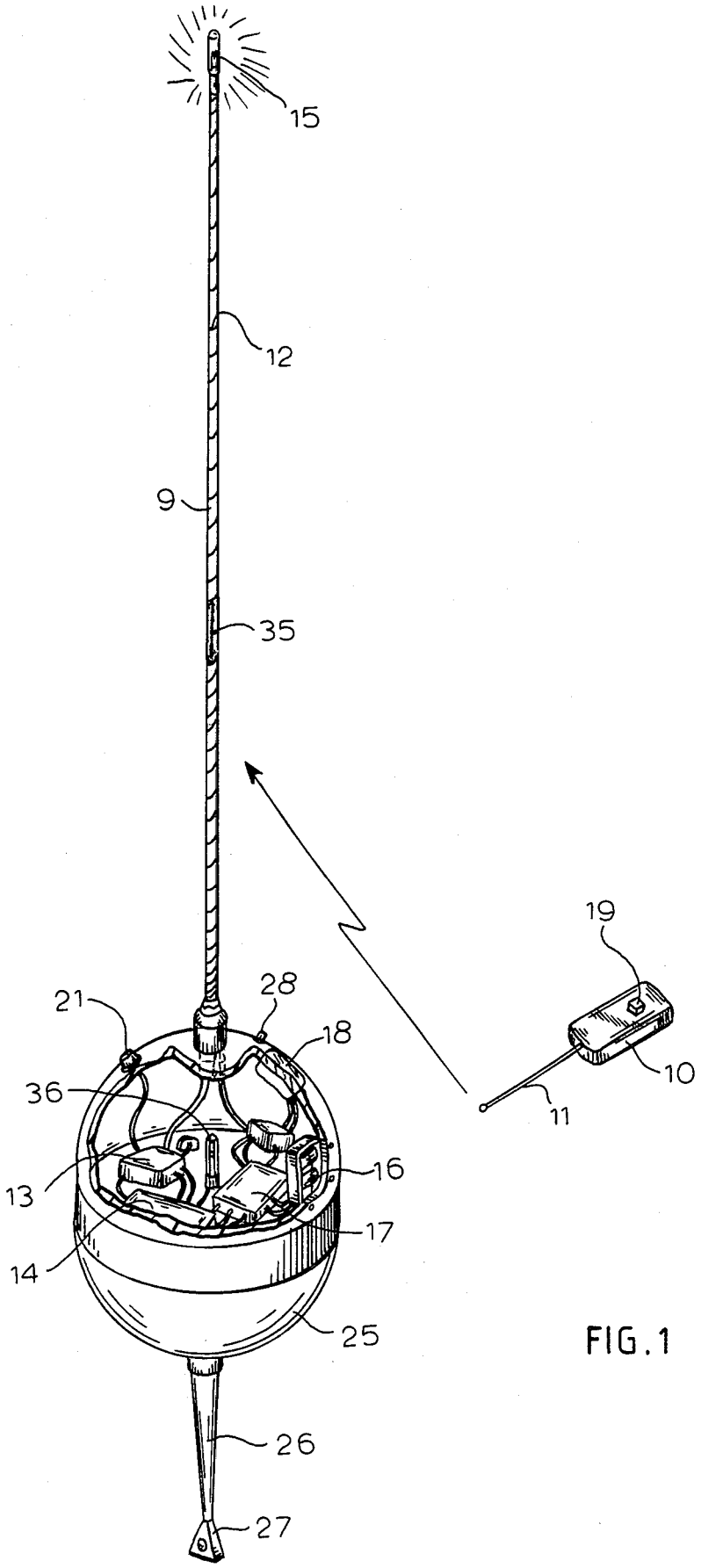
FIG. 1 is a perspective view, partly in cross section showing a first embodiment of the invention in a pick-up buoy.
Figure 2:
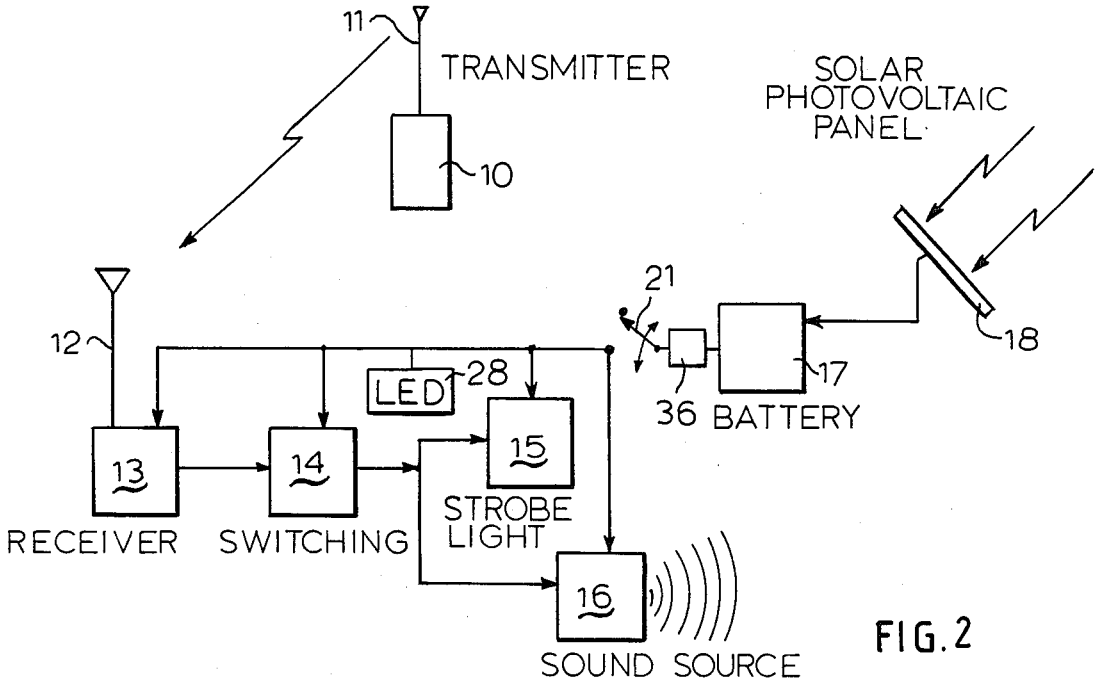
FIG. 2 is an electrical block diagram of the transmitter and receiving system according to the invention.

Referring to FIGS. 1–4, there is shown a pick-up buoy comprised of a floating base 25 having a downwardly extending stem 26 onto which is secured at its end a lead weight 27 having an opening for being secured to a mooring chain. The top half of the pick-up buoy contains a hollow hemisphere in which is disposed a radio receiving circuit comprised in part of an RF receiver 13, a switching circuit 14, and a battery 17. Disposed along the outer shell on the inside of the hollow hemisphere of the pick-up buoy is optionally a sound source 16 and also a solar photovoltaic panel 18 pointed upwardly toward the sky. A small light emitting diode (LED) lamp 28 may also optionally be provided on the surface of the pick-up buoy, as well as a switch 21. The stem of the pick-up buoy 9, which is connected to the top of the hollow hemisphere, is wrapped with an antenna wire 12 designed for receiving external RF signals. Preferably embedded in the center is a second wire that is connected to a flash or strobe lamp 15 secured to the end of stem 9. In a typical pick-up buoy, the stem is usually 4–6 feet in length. The top end of antenna wire 12 may also be connected to flash lamp 15 to complete the electrical circuit. The center conductor can also be comprised of two separate wires 35 to connect to flash lamp 15. A waterproof on/off button 21 can also be mounted near the top of the hemisphere shell of the pick-up buoy to turn on and off the unit. In addition, a position sensitive mercury switch 36 may also be provided to disconnect the battery from the circuit when the pick-up buoy is retired from use by placing it on the deck of the boat in a horizontal position.

In a preferred embodiment, battery 17 would preferably be a rechargable battery and connected to solar cell 18 so that during the day, it can be continuously charged and ready for use.

The hollow top portion of the pick-up buoy is preferably water tight and sealed against moisture since it will be deployed on the surface of the water. The top half may, for example, be threadably coupled to the lower half through sealed threads or by means of an O-ring seal so that the top half will be sealed from the weather and elements. Switch 21 is preferably a rubber or waterproof switch and all external mountings, such as the stem, antenna, and LED lamp 28 will be sealed to the surface of the buoy.

In another embodiment, the mooring buoy which is generally a large spherical or conically shaped floating buoy for supporting the anchor chain, may also be provided with the locating system of the present invention. In this case, the mooring buoy would have its flashing lamp mounted adjacent to its top surface and would contain a flat antenna embedded in the surface of the mooring buoy.

In operation, when a boat is about to leave the harbor area, the operator of the boat will depress switch 21 to activate the locating system before dropping the buoy in the water. This will connect battery 17, as shown in detail in FIG. 2, to the RF receiver and switching circuit. When the boat returns to the mooring area such as at night or during fog, the operator of the boat will depress switch 19 of transmitter 10 to send a signal from transmitter antenna 11 to the mooring area. Receiving antenna 12 will receive and send the transmitted RF signal to receiver 13. Receiver 13 will be tuned to a specific frequency so that only signals of an assigned frequency will be received and produce an output at the receiver to turn on switching circuit 14. Switching circuit 14 will then operate strobe light 15 and optionally sound beeper 16 so that the pick-up buoy will both flash a signal and produce a beeping sound to the approaching vessel.

Figure 3:
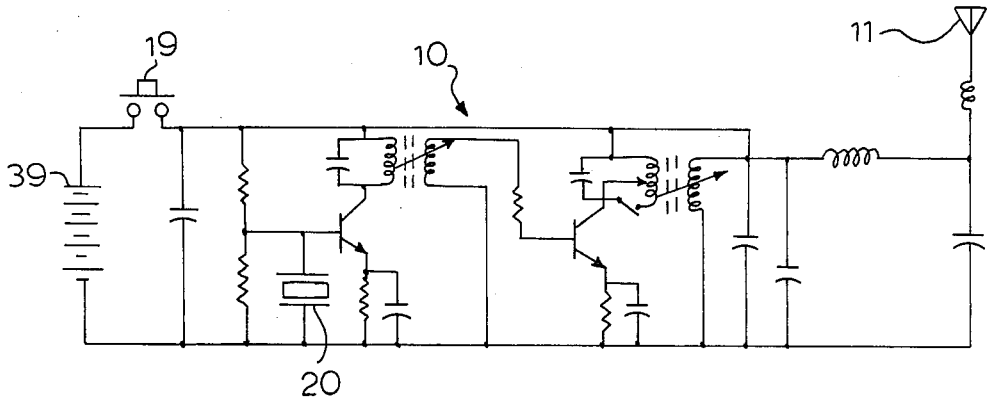
FIG. 3 is a detailed schematic diagram of the transmitting system.

As shown in detail in FIG. 3, the transmitter circuit for transmitter 10 consists of a switch 19 to connect battery 39 to a crystal controlled oscillator for transmitting from antenna 11 an assigned and stable RF frequency. Where transmitted frequencies such as 20–200 Mhz are used, it is necessary only to transmit a low power signal for a few hundred yards, in order to activate receiver 13.

Figure 4:
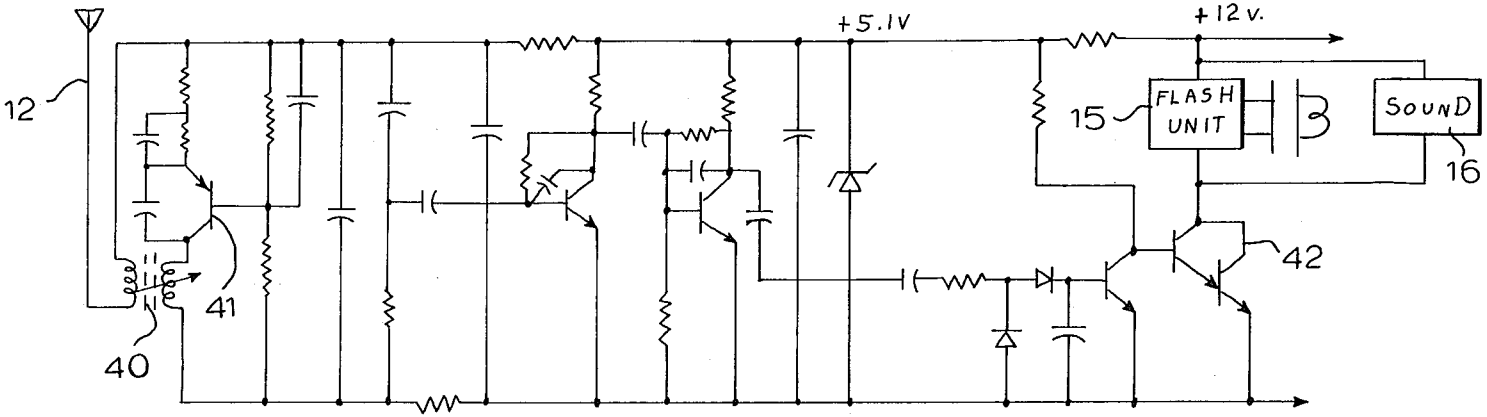
FIG. 4 is a detailed schematic diagram of the receiver switching circuit, light and sound source of the invention.

As shown in detail in FIG. 4, receiver 13 will include a tuned RF circuit 40 at the input stage of the first RF amplifier that will be tuned to the RF frequency of transmitter 10. Subsequent amplifier stages will amplify the signal so as to turn on by means of transistor switch 42, flash unit 15 and the sound source 16. The receiver is designed to draw low power from battery 17 while it is standing by for a signal from transmitter 10.

Receiver 13 may also be tuned to one of the VHF marine radio telephone channels so that the vessel can also use its marine radio, tuned to a particular channel to operate the locating buoy. In this case, the receiver or antenna can be adjusted so that only strong RF marine signals transmitted on the assigned frequency and within a few hundred yards of the buoy will turn on the receiver and operate the locating system of the invention.

Lamp 15 is preferably constructed of a gas Xenon strobe lamp having a high voltage flashing circuit built in, and responsive to switch 14 for flashing the xenon tube strobe lamp intermittently. Lights of this type can be seen at great distances at night. Lamp 15 may also be a bright incandescent lamp designed to flash intermittently in response to the transmitted radio signal from transmitter 10.

While only a few embodiments of the present invention have been shown and described, it will be obvious that many changes and modifications may be made thereunto, without departing from the spirit and scope of the invention.

What is claimed is:

1. A mooring locating system for marine vessels that is responsive to a transmitted RF signal of a set frequency transmitted from the marine vessel, comprising:

a floating pick-up buoy for retrieval by the marine vessle having a buoyant, water tight container and including an elongated stem disposed vertically on the top of said buoy;

a stem extending downwardly from said floating pick-up buoy for attachment to mooring lines of a fixed mooring so that upon retrieval of the pick-up buoy the vessel can be secured to its mooring;

an RF receiver disposed within the water tight container and tuned to the set frequency of the transmitted RF signal, said receiver producing a signal at its output in response to the RF signal;

an antenna wrapped along the length of said vertical elongated stem and coupled to the input of said RF receiver;

a switching circuit coupled to the RF receiver and responsive to the output signal of said receiver to produce a switching signal;

a lamp disposed at the free end of said elongated stem and having its input coupled to the output of said switching circuit and responsive to the switching signal thereof to turn on said lamp; and a battery power source disposed within said buoyant container and coupled to said RF receiver, said switching circuit, and said lamp.

2. The locating system as recited in claim 1, additionally comprising a sound source coupled to the output of said switching circuit and disposed on the surface of said buoy for sounding an audible signal in response to the transmitted RF signal at the set frequency.

3. The locating system as recited in claim 1, additionally comprising a solar cell disposed on the surface of said buoy for optical contact with the sky, and coupled to said battery power source.

4. The locating system as recited in claim 1, additionally comprising an LED lamp disposed on the surface of said buoy and coupled to said receiver for indicating the "on" and "off" condition of said system.

5. The locating system as recited in claim 1, additionally comprising a switch disposed on the surface of said buoy for turning the system on and off.

6. The locating system as recited in claim 1, additionally comprising a position sensitive mercury switch coupled between said battery power source and said receiver for turning off said power source when the buoy is inclined substantially horizontally.

7. The locating system as recited in claim 1, wherein said lamp comprises a Xenon flash tube.

8. The locating system as recited in claim 1, wherein said lamp comprises an incandescent light bulb.

* * * * *